US005128310A

United States Patent [19]

Mitsuo et al.

[11] Patent Number: 5,128,310

[45] Date of Patent: Jul. 7, 1992

[54] THERMOSENSITIVE RECORDING MATERIAL

[75] Inventors: Hirofumi Mitsuo; Yoshiyuki Hoshi, both of Shizuoka, Japan

[73] Assignee: Fuji Photo Film Co., Ltd, Kanagawa, Japan

[21] Appl. No.: 716,872

[22] Filed: Jun. 18, 1991

[30] Foreign Application Priority Data

Jun. 18, 1990 [JP] Japan ..... 2-160488

[51] Int. Cl.[5] ..... B41M 5/40

[52] U.S. Cl. ..... 503/226; 427/152; 503/200; 503/207

[58] Field of Search ..... 427/152; 503/200, 207, 503/226

[56] References Cited

FOREIGN PATENT DOCUMENTS 0186375 7/1986 European Pat. Off. ..... 503/200
0329384 8/1989 European Pat. Off. ..... 503/200
0341715 11/1989 European Pat. Off. ..... 503/200
0361501 4/1990 European Pat. Off. ..... 503/200
2183354 6/1987 United Kingdom ..... 503/200
2198856 6/1988 United Kingdom ..... 503/200

*Primary Examiner*—Pamela R. Schwartz
*Attorney, Agent, or Firm*—Sughrue, Mion, Zinn, Macpeak & Seas

[57] ABSTRACT

A thermosensitive recording material which comprises a support having a low Streckigt sizing degree, an undercoat layer comprising an oil absorbable pigment and a carboxymethyl cellulose, and a thermosensitive recording layer coated on the undercoat layer.

The thermosensitive recording material of this invention can be used in a high speed recording system, since it has a high sensitivity, a high image quality and a low capacity to adhere stain to a thermal head, and these advantages can be improved further by adding an appropriate amount of paraffin wax to the undercoat layer. The thermosensitive recording material can be produced economically because a low cost material having a low Steckigt degree can be used as the support.

2 Claims, No Drawings

THERMOSENSITIVE RECORDING MATERIAL

BACKGROUND OF THE INVENTION

This invention is directed to thermosensitive recording materials for use in facsimile, thermal printer, hot-pen recording systems and the like. More particularly, it relates to a low cost thermosensitive recording material which has a high sensitivity and high image quality.

Recording materials containing an electron donating dye precursor and an electron accepting compound are well known as materials for use in such applications as pressure sensitive recording paper, thermosensitive recording paper, photo- and thermosensitive recording paper, electrothermosensitive recording paper and the like. Such applications are disclosed in detail for example in British Patent 2,140,499, U.S. Pat. No. 4,480,052, U.S. Pat. No. 4,436,920, JP-B-60-23922, (the term "JP-B" as used herein means an "examined Japanese patent publication"), JP-A-57-179836 (the term "JP-A" as used herein means an "unexamined publication Japanese patent application"), JP-A-60-123556 and JP-A-60-123557.

Because of the advance in the development of high speed, low energy recording instruments triggered by the recently expanding use of thermosensitive recording materials in various fields, there is a great demand for a thermosensitive recording material which possesses a high sensitivity and a high image quality, but has a low capacity to adhere stains to a thermal head. To satisfy these demands, various techniques have been proposed such as a process in which an undercoat layer is inserted between a support and a thermosensitive recording layer and, as disclosed in JP-A-2-1369, a process in which components of a coating solution and their contents and the like are specified. These prior art processes, however, do not show satisfactory results. The production cost of a thermosensitive recording material greatly depends on its support material. A material having a low Steckigt sizing degree of 10 seconds or below may be useful as a low cost support. Such a support, however, is apt to cause deterioration of the surface conditions of an undercoat layer, especially when a blade coater is used, and therefore to cause the problem of decreasing sensitivity and image quality of the resulting thermosensitive recording material.

SUMMARY OF THE INVENTION

In view of the above, it is an object of the present invention to provide a thermosensitive recording material, containing a low cost support, which possesses a high sensitivity, a high image quality and a low capacity to adhere stains to a thermal head and can thus be applied to a high speed recording system.

The present inventors have conducted intensive studies with the goal of solving the aforementioned prior art problems and have found that thermal sensitivity and image quality of a thermosensitive recording material are greatly dependent upon the capacity of a support. Further, sufficient thermal sensitivity and image quality can be obtained by employing an appropriate undercoat layer even when a low cost support having a Steckigt sizing degree of 10 seconds or less is used. The aforementioned object of the present invention has been attained by a thermosensitive recording material which comprises a support having a Steckigt sizing degree of from 5 to 10 seconds, an undercoat layer comprising an oil absorbable pigment coated on the support by blade coating and a thermosensitive recording layer coated on the undercoat layer. The undercoat layer further comprises a carboxymethyl cellulose having an etherification degree of from 0.6 to 0.8 and a mean molecular weight of from 20,000 to 200,000. The carboxymethyl cellulose is present in an amount of from 1 to 5% by weight based on the pigment.

DETAILED DESCRIPTION OF THE INVENTION

In the present invention, Steckigt sizing degree of a support is measured in accordance with the Japanese Industrial Standard (JIS) P-8122. Base weight of the support in the invention is preferably from 30 to 70 g/m$^2$, more preferably 35 to 50 g/m$^2$.

According to the present invention, the term "undercoat layer" means a layer which is coated on a support having a Steckigt sizing degree of from 5 to 10 seconds. The undercoat layer contains an oil absorbable pigment and a binder as the main components, as well as a specific amount of a specific carboxymethyl cellulose. The undercoat layer preferably contains 80 to 95% oil absorbable pigment and 5 to 20% binder, by weight as solid contents.

Illustrative examples of the oil absorbable pigment include baked kaolin, aluminum oxide, magnesium carbonate, calcium carbonate, amorphous silica, baked diatomaceous earth, aluminum silicate, magnesium aluminosilicate, aluminum hydroxide and the like. The most preferable pigments are those having an oil absorption value (based on JIS-K5101) of 70 ml/100 g or more.

A binder appropriate for use in the present invention may be selected from water soluble polymers such as starch (including modified starch), casein, polyvinyl alcohol, methyl cellulose, hydroxyethyl cellulose, polyacrylic acid and the like, and latexes such as SBR (styrene-butadiene copolymer) and MBR (methylmethacrylate-butadiene copolymer). The binder may be used generally in an amount of from 7 to 20 parts based on 100 parts of the oil absorbable pigment, depending on the intended film strength of a coating layer, the thermal sensitivity of a thermosensitive recording layer and the like. Too much binder is harmful because desired insulation caused by a reduction in the percentage of void in the undercoat layer, though one of the purposes of employing an oil absorbable pigment is to improve thermal insulation. Also, too much binder may result in adhesion of stains to a thermal head. If the amount of binder is too small, it will have no significant results but rather reduce film strength and adhesion capacity of a coating layer.

As described above, a coating solution for use in the formation of the undercoat layer of the present invention contains an oil adsorbable pigment and a binder as the main components. Excellent surface smoothness and other surface characteristics of the undercoat layer may be obtained if the coating solution possesses a fluidity at the time of blade coating. For this reason, a carboxymethyl cellulose having an etherification degree of from 0.6 to 0.8 and a mean molecular weight of from 20,000 to 200,000 is added to the coating solution in an amount of from 1 to 5% by weight, preferably from 1 to 3% by weight, based on the aforementioned oil absorbable pigment.

Addition of the carboxymethyl cellulose to the coating solution permits the use of a material having low Steckigt sizing degree of 10 seconds or lower as a support for use in the thermosensitive recording material.

If the amount of the carboxymethyl cellulose is less than 1% by weight, the effect of the oil absorbable pigment to give fluidity to the coating solution under a high shearing stress will deteriorate markedly, which will cause various troubles on the surface of the layer such as streak and stlactit. Such troubles have occurred frequently, especially when a support having a low Steckigt sizing degree is used as in the case of the present invention.

Addition of more than 5% by weight of the carboxymethyl cellulose increases static viscosity, reducing workability. Further, electrolytic corrosion of a thermal head is exacerbated by the increased sodium ion content.

In the invention, the oil absorbable pigment may be added while stirred to mixture of a dispersing agent with water followed by dispersing, and then the binder may be added to the dispersion to prepare the coating solution for undercoat layer.

As has been described in the foregoing, the undercoat layer of the present invention, which is obtained by blade-coating a coating solution and contains a specified carboxymethyl cellulose on a support having a Steckigt sizing degree of from 5 to 10 seconds, has an excellent surface smoothness and other surface characteristics. It possesses a high percentage of void due to the effect of the oil absorbable pigment. Because of these excellent properties, unlike an undercoat layer in which such a carboxymethyl cellulose is not used, the undercoat layer of the present invention can contribute greatly to the production of a thermosensitive recording material which has a high thermal sensitivity and a high image quality and is almost free from adhesion of stains to a thermal head.

Further improved effect can be obtained by adding a wax to the undercoat layer of the present invention. The addition of a wax increases water retentivity of a coating solution for use in a thermosensitive recording layer to be coated on the undercoat layer. An increase in the water retentivity renders possible the formation of a homogeneous thermosensitive recording layer. Such an embodiment, therefore, is especially preferable for the purpose of the present invention. As the source of wax appropriate for the present invention, paraffin wax is most preferable in an amount from 0.5 to 10% by weight based on the oil absorbable pigment, more preferably from 1.5 to 5% by weight.

If necessary, other pigments, dispersants, various auxiliaries and the like may be added to the coating solution for use in the undercoat layer of the present invention, provided that these additives are used in amounts which do not inhibit the effects of the resulting thermosensitive recording material.

Glue spread of the undercoat layer, though not especially limited, may preferably be adjusted in the range of about 1 to 20 g/m$^2$, more preferably 5 to 15 g/m$^2$, depending on the desired properties of the thermosensitive recording material.

Blade coating techniques for use in coating the undercoat layer of the present invention include not only a method in which a bevel type blade or a vent type blade is employed but also a rod blade coating method, bill-blade coating method and the like. Blade coating may be effected by the use of not only an off machine coater but also an on machine coater attached to a paper machine. Such an on machine coater is especially preferable for use in the present invention, because a paper support is subjected to the coating progress before the support exhibits its sizing effect.

According to the present invention, there is no special limitation with regard to the combination of coloring components in a thermosensitive recording layer which is coated on the undercoat layer. For example, any combination of coloring components can be used, provided that these compounds can contact each other and show a coloring reaction when they are exposed to heat. Illustrative examples of such combinations include a combination of an electron donating dye precursor with an electron accepting compound, a combination of a higher fatty acid metal salt such as ferric stearate with a phenol such as gallic acid, a combination of a diazonium compound with a coupler and a base compound and the like. Among these combinations, combinations of an electron donating dye precursor (a color former) and an electron accepting compound (a color developer) may be most preferable for the present invention in view of the thermal sensitivity and image quality they afford.

The color former for use in the present invention may be selected from various known compounds such as triarylmethane compounds, diphenylmethane compounds, xanthene compounds, thiazine compounds, sriropyran compounds and the like. Illustrative examples of these compounds are disclosed for instance in JP-A-55-227253 which include: triarylmethane compounds such as 3,3-bis(p-dimethylaminophenyl)-6-dimethylamino phthalide, 3,3-bis(p-dimethylaminophenyl) phthalide, 3-(p-dimethylaminophenyl)-3-(1,3 dimethylindole-3-yl) phthalide, 3-(p-dimethylaminophenyl)-3-(2-methylindole-3-yl) phthalide and the like; diphenylmethane compounds such as 4,4-bis-dimethylaminobenzhydrin benzyl ether, N-halophenyl leucoauramine, N-2,4,5,-trichlorophenyl leucoauramine and the like; xanthene compounds such as Rhodamine B anilinolactam, Rhodamine-(p-nitrino) lactam, 2-(dibenzylamino) fluoran, 2-anilino-3-methyl-6-diethylaminofluoran, 2-anilino-3-methyl-6-dibutylaminofluoran, 2-anilino-3-methyl-6-N-ethyl-N-isoamylaminofluran, 2-anilino-3-methyl-6-N-methyl-N-cyclohexylaminofluran, 2-anilino-3-chloro-6-diethylaminofluoran, 2-anilino-3-methyl-6-N-ethyl-N-isobutylfluoran; 2-anilino-6-dibutylaminofluoran, 2-anilino-3-methyl-6-N-methyl-N-tetrahydrofurfurylaminofluoran, 2-(o-anilino-3-methyl-6-piperidinoaminofluoran, 2-(o-chloroanilino)-6-diethylaminofluoran, 2-(3,4-dichloroanilino)- 6-diethylaminofluoran and the like; thiazine compounds such as benzoyl Leucomethylene Blue, p-nitrobenzyl Leucomethylene Blue and the like; spiropyran compounds such as 3-methyl-spiro-dinaphthopyran, 3-ethyl-spirodinaphthopyran, 3-3,-dichloro-spiro-dinaphthopyran, 3-benzylspiro-dinaphthopyran, 3-methyl-naphtho-(3-methoxy-benzo)-spiropyran, 3-propyl-spiro-dibenzopyran and the like; and many other related compounds.

The color developer for use in the present invention may be selected from various compounds, but preferably from phenolic compounds, salicylic acid derivatives and polyvalent metal salts thereof, to prevent surface fogging. Illustrative examples of such phenolic compounds include 2,2,-bis(4-hydroxyphenyl) propane (namely, bisphenol A), 4-t-butylphenol, 4-phenylphenol, 4-hydroxydiphenoxide, 1,1,-bis(4-hydroxyphenyl) cyclohexane, 1,1,-bis(3-chloro-4-hydroxyphenyl) cyclohexane, 1,1,-bis(3-chloro-4-hydroxyphenyl)2-ethyl butane, 4,4,-sec-isooctylidene diphenol, 4,4,-sec-butylidene diphenol, 4-tert-octyl phenol, 4-p-methylphenyl phenol, 4,4,-methylcyclohexylidene phenol, 4,4,-isopentylidene phenol, benzyl p-hydroxybenzoate and the like. Illustrative examples of the salicylic acid derivatives include 4-pentadecyl salicylic acid, 3,5-di(α-methylbenzyl) salicylic acid, 3,5-di(tert-octyl) salicylic acid, 5-octadecyl salicylic acid, 5-α-(p-α-methylvenzylphenyl) ethyl salicylic acid, 3-α-methylbenzyl-5-tert-octyl salicylic acid, 5-tetradecyl salicylic acid, 4-hexyloxy salicylic acid, 4-cyclophexyloxy salicylic acid, 4-decyloxy salicylic acid, 4-dodecyloxy salicylic acid, 4-pentadecyloxy salicylic acid, 4- octadecyloxy salicylic acid and the like, and zinc, aluminum, calcium, copper and lead salts of these salicylic compounds.

These color developers may preferably be used in an amount of from 50 to 800% by weight based on the color former, more preferably from 100 to 500% by weight. The amount of less than 50% would cause insufficient color development and the addition of more than 800% would provide no proportionally greater effect.

For the purpose of improving the thermal response of the thermosensitive recording material of the present invention, a heat fusible compound may be included in the thermosensitive recording layer. Illustrative examples of the heat fusible compound appropriate for the present invention include benzyl p-benzyloxybenzoate, β-naphthylbenzyl ether, stearic acid amide, stearylurea, p-benzylbiphenyl, di(2-methylphenoxy) ethane, di(2-methoxyphenoxy) ethane, β-naphthol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy) ethane, 1-phenoxy-2-(chlorophenoxy) ethane, 1,4-butanediolphenyl ether, diethylenegycol-bis(4-methoxyphenyl) ether and the like. These heat fusible compounds may be used alone or as a mixture thereof. For the purpose of obtaining sufficient thermal response, the heat fusible compound may preferably be used in an amount of from 10 to 400% by weight on the basis of the color developer, more preferably from 50 to 250%.

According to the present invention, the dispersion of the color former, the color developer, and heat fusible compound or the like is carried out using a water soluble binder. A binder suitable for the present invention may preferably have a solubility of 5% by weight or more in water at 25° C. Illustrative examples of such water soluble binders include a polyvinyl alcohol, a methyl cellulose, a carboxymethyl cellulose, starch materials (including a modified starch), gelatin, gum arabic, casein, a saponified product of a styrene-maleic anhydride copolymer and the like. These water soluble binders may be used not only at the time of the dispersion step but also for the purpose of improving film strength of a thermosensitive recording layer. For this purpose, the water soluble binder may be used jointly with a synthetic polymer latex binder such as a styrene-butadiene copolymer, a vinyl acetate copolymer, an acrylonitrilebutadiene copolymer, a methylacrylate-butadiene copolymer, a polyvinylidene chloride or the like.

The foregoing color former, color developer, heat fusible compound and the like are made into a coating solution by dispersing them separately or simultaneously, using a mixer or a grinder such as a ball mill, an attritor, a sand mill or the like. If desired, the coating solution may be further mixed with other additives such as a pigment, a metallic soap, a wax article, a surfactant, an antistatic agent, an ultraviolet ray absorption agent, an antifoaming agent, a fluorescence dyestuff and the like.

Calcium carbonate, barium sulfate, lithopone, agalmatolite, kaolin, baked kaolin, amorphous silica, aluminum hydroxide or the like may be used as a pigment additive.

As the metallic soap, metal salts of higher fatty acids may be useful, for instance zinc stearate, calcium stearate and aluminum stearate.

As the wax articles, a paraffin wax, a microcrystalline wax, a carnauba wax, methylolstearoamide, a polyethylene wax, a polystyrene wax, a fatty acid amide wax and the like may be used alone or as a mixture thereof.

An alkali metal salt of sulfosuccinic acid and a fluorine-containing surfactant may be useful as the surfactant.

The addition of an anti-achromation agent to the thermosensitive recording layer is desirable for the purpose of preventing achromatic of image printing parts and thereby solidifying formed image. Phenolic compounds, especially hindered phenol compounds, may be effective as the antiachromation agent. Illustrative examples of such compounds include 1,1,3-tris(2-methyl-4-hydroxy-tert-butylphenyl) butane, 1,1,3-tris(2-ethyl-4-hydroxy-5-tert-butylphenyl) butane, 1,1,3-tris(3,5-di-tert-butyl-4-hydroxyphenyl) butane, 1,1,3-tris(2-methyl-4-hydroxy.-5-tert-butylphenyl) propane, 2,2,-methylene-bis(6-tert-butyl-4-methylphenol), 2,2,-methylene-bis-(6-tert-butyl-4-ethylphenol), 4,4,-butylidenebis(6-tert-butyl-3-methylphenol) and 4,4,-thio-bis(3-methyl6-tert-butylphenol). Such phenolic compounds may preferably be used in an amount of from 1 to 200% by weight on the basis of the color developer, more preferably from 5 to 50%.

These foregoing materials are mixed respectively and then applied to a supporting material. Though not restricted, a coating solution thus prepared is coated on a support by an air knife coater, a roll coater, a blade coater, a curtain flow coater or the like and then dried and subjected to smoothing treatments such as calendering prior to its practical use.

A coating solution for use in the thermosensitive recording layer, though not especially restricted, may preferably be coated on a support with a glue spread of about 2 to 7 g/m$^2$ as dry weight.

The present invention will now be described by way of the following examples which should be regarded as illustrative rather than restrictive. In these examples the terms "parts" and "%" are indicated by weight unless otherwise noted.

EXAMPLE 1

Preparation of undercoat solution (1)

Undercoat solution (1) for use in the coating of an undercoat layer was prepared by mixing and dispersing the following composition:

100 parts of a baked kaolin (Ansilex 90, manufactured by Engelhard Corp.; oil absorption, 75 ml/100 g), 1 part of sodium hexametaphosphate, 20 parts of 30% aqueous solution of an oxidized starch, 15 parts of a styrene-butadiene copolymer latex 48%), 40 parts of 5% aqueous solution of a carboxymethyl cellulose (etherification degree, 0.65; mean molecular weight, 100,000), and 66 parts of water.

Formation of undercoat layer (1)

A predetermined amount of the thus prepared undercoat solution (1) was coated with a blade coater on a support having a Steckigt sizing degree of 7 seconds and a basis weight of 45 g/m$^2$. Thereafter, the coated solution was dried to obtained undercoat layer (1) having a glue spread of 8 g/m$^2$.

Preparation of thermosensitive recording layer solution

Solution A

A dispersant having a mean particle size of 1.0 μm was prepared by mixing the following composition using a sand mill:

10 parts of 3-dibutylamino-6-methyl-7-anilinofluoran and 50 parts of 5% solution of a polyvinyl alcohol (PVA-105).

Solution B

A dispersant having a mean particle size of 1.0 μm was prepared by mixing the following composition using a sand mill:

20 parts of bisphenol A.

20 parts of naphthylbenzyl ether, and 200 parts of 5% solution of a polyvinyl alcohol.

Solution C

A pigment dispersant having a mean particle size of 2.0 μm was prepared by mixing the following composition using a sand mill:

40 parts of precipitated calcium carbonate, 1 part of 40% solution of sodium polyacrylate, and 60 parts of water.

A coating solution for use in a thermosensitive recording layer was obtained by mixing 60 parts of the Solution A with 240 parts of the Solution B, 101 parts of the Solution C and 25 parts of a 21% water-dispersion of zinc stearate.

Preparation of thermosensitive recording material

A predetermined amount of the thus prepared thermosensitive recording layer solution was coated on the previously prepared undercoat layer using an air knife coater. Thereafter, the coated solution was dried and subjected to calendering to obtain a thermosensitive recording material with its thermosensitive recording layer having a glue spread of 5.5 g/m$^2$:

EXAMPLE 2

Preparation of undercoat solution (2)

Undercoat solution (2) for use in the coating of an undercoat layer was prepared by mixing and dispersing the following composition:

100 parts of a baked kaolin (Ansilex 90, manufactured by Engelhard Corp.; oil absorption, 75 ml/100 g), 1 part of sodium hexametaphosphate, 20 parts of 30% aqueous solution of an oxidized starch, 15 parts of a styrene-butadiene copolymer latex (48%), 40 parts of 5% aqueous solution of a carboxymethyl cellulose (etherification degree, 0.80; mean molecular weight, 100,000), and 66 parts of water.

Formation of undercoat layer (2)

A predetermined amount of the thus prepared undercoat solution (2) was coated on a support having a Steckigt sizing degree of 7 seconds and a basis weight of 45 g/m$^2$ using a blade coater. Thereafter, the coated solution was dried to obtain undercoat layer (2) having a glue spread of 8 g/m$^2$.

Preparation of thermosensitive recording material

A thermosensitive recording material was obtained by repeating the process of Example 1 except that the undercoat layer (1) used in Example 1 was replaced by the undercoat layer (2).

EXAMPLE 3

A thermosensitive recording material was obtained by repeating the process of Example 1 except that the support used in Example 1 was replaced by another support having a Steckigt sizing degree of 5 seconds and a basis weight of 45 g/m$^2$.

EXAMPLE 4

A thermosensitive recording material was obtained by repeating the process of Example 1 except that the carboxymethyl cellulose having an etherification degree of 0.65 and a mean molecular weight of 100,000 used in Example 1 as the undercoat layer solution (1) was replaced by a carboxymethyl cellulose having an etherification degree of 0.65 and the mean molecular weight of 180,000.

EXAMPLE 5

A thermosensitive recording material was obtained by repeating the process of Example 1 except that the carboxymethyl cellulose having an etherification degree of 0.65 and a mean molecular weight of 100,000 used in Example 1 as the undercoat layer solution (1) was replaced by a carboxymethyl cellulose having an etherification degree of 0.65 and a mean molecular weight of 30,000.

EXAMPLE 6

A thermosensitive recording material was obtained by repeating the process of Example 1 except that the undercoat layer solution (1) used in Example 1 was replaced by an undercoat layer solution prepared by mixing and dispersing the following composition:

100 parts of baked kaolin (Ansilex 90, manufactured by Engelhard Corp.; oil absorption, 75 ml/100 g).

1 part of sodium hexametaphosphate, 20 parts of 30% aqueous solution of an oxidized starch, 15 parts of a styrene-butadiene copolymer latex (48%), 40 parts of 5% aqueous solution of a carboxymethyl cellulose (etherification degree, 0.80; mean molecular weight, 100,000), 10 parts of 30% water-dispersion of paraffin wax (135° F.), and 66 parts of water.

COMPARATIVE EXAMPLE 1

An undercoat layer solution was prepared by repeating the process of Example 1 except that the carboxymethyl cellulose used in Example 1 was replaced by another carboxymethyl cellulose having an etherification degree of 0.65 and a mean molecular weight of 300,000. The thus prepared undercoat solution was coated on a support having a Steckigt sizing degree of 7 seconds and a basis weight of 45 g/m$^2$ using a blade coater. The undercoat solution was used in such an amount that a glue spread would become 8 g/m$^2$ when the coated solution was dried. In this attempt, however, undercoat layer did not form because of a high static viscosity (2,300 cp) which lowered workability of the process to almost impossible level.

COMPARATIVE EXAMPLE 2

A thermosensitive recording material was obtained by repeating the process of Example 1 except that the carboxymethyl cellulose having an etherification degree of 0.65 and a mean molecular weight of 100,000 used in Example 1 as the undercoat layer solution (1) was replaced by another carboxymethyl cellulose having an etherification degree of 0.65 and a mean molecular weight of 15,000.

COMPARATIVE EXAMPLE 3

A thermosensitive recording material was obtained by repeating the process of Example 1 except that the support used in Example 1 was replaced by a support having a Steckigt sizing degree of 4 seconds and a basis weight of 45 g/m$^2$.

COMPARATIVE EXAMPLE 4

A thermosensitive recording material was obtained by repeating the process of Example 1 except that the carboxymethyl cellulose having an etherification degree of 0.65 and a mean molecular weight of 100,000 used in Example 1 as the undercoat layer solution (1) was replaced by a carboxymethyl cellulose having an etherification degree of 0.50 and a mean molecular weight of 100,000.

COMPARATIVE EXAMPLE 5

A thermosensitive recording material was obtained by repeating the process of Example 1 except that the carboxymethyl cellulose having an etherification degree of 0.65 and a mean molecular weight of 100,000 used in Example 1 as the undercoat layer solution (1) was replaced by a carboxymethyl cellulose having an etherification degree of 1.0 and a mean molecular weight of 100,000.

The thermosensitive recording materials obtained in Examples 1 to 6 and Comparative Examples 1 to 5 were tested for their dynamic sensitivities, image qualities, stain adhesion frequencies to a thermal head and surface characteristics in accordance with the following evaluation methods. The results are shown in Table 1.

Dynamic sensitivity

Printing on the thus obtained thermosensitive recording materials was carried out by using an experimental apparatus for thermosensitive printing, which was equipped with a thermal head (Trade name, KTL-2168-MPDI; manufactured by Kyocera Corp.) and a pressure roll (100 kg/cm$^2$) attached directly to the thermal head, under the pressure rolling conditions of 24 V head voltage and 10 ms pulse cycle, with a pulse width of 0.8 ms. Print density on the thus printed material was measured using a Macbeth-type reflection density meter, RD-918.

Image quality

The printed samples thus obtained were evaluated macroscopically using the following evaluation criteria:

A . . . Good
B . . . Bad
C . . . Extremely bad

Stain adhesion to thermal head

A two meter long test pattern with 100% blackness was printed on each thermosensitive recording material using the aforementioned experimental apparatus for thermosensitive printing, and the amount of stains adhered to the thermal head was observed macroscopically with the following evaluation criteria:

A . . . Good
B . . . Bad
C . . . Extremely bad

Surface conditions

The degree of track mark troubles such as streak and stlactit and coating workability were evaluated as the surface characteristics using the following evaluation criteria:

A . . . Markedly good
B . . . Problematic
C . . . Extremely problematic/Not coatable

TABLE 1

| | Sensitivity | Image Quality | Adhesion of Stains | Surface Conditions |
|---|---|---|---|---|
| Example 1 | 1.36 | A | A | A |
| Example 2 | 1.35 | A | A | A |
| Example 3 | 1.33 | A | A | A |
| Example 4 | 1.34 | A | A | A |
| Example 5 | 1.35 | A | A | A |
| Example 6 | 1.38 | A | A | A |
| Comparative Example 1 | — | — | — | not coatable |
| Comparative Example 2 | 1.28 | A | B | B |
| Comparative Example 3 | 1.20 | C | B | C |
| Comparative Example 4 | 1.26 | A | B | B |
| Comparative Example 5 | 1.21 | B | B | B |

Thus, it is apparent that there has been provided, in accordance with the present invention, a thermosensitive recording material which has a high sensitivity, a high image quality, and a low stain adhesion capacity to a thermal head.

While the present invention has been described in conjunction with specific embodiments thereof, it is evident that many alternatives, modifications and variations will be apparent to those skilled in the art in light of the foregoing description. Accordingly, it is intended to include all such alternatives, modifications and variations within the spirit and scope of the appended claims.

What is claimed is:

1. A thermosensitive recording material, comprising a support having a Stockigt sizing degree of from 5 to 10 seconds, an undercoat layer comprising an oil absorbable pigment coated on said support by blade coating and a thermosensitive recording layer coated on said undercoat layer, wherein said undercoat layer further comprises a carboxymethyl cellulose having an etherification degree of from 0.6 to 0.8 and a mean molecular weight of from 20,000 to 200,000, and wherein said carboxymethyl cellulose is present in an amount of from 1 to 5% by weight based on the pigment.

2. The thermosensitive recording material according to claim 1, wherein said undercoat layer further contains 0.5 to 10% by weight of paraffin wax based on said oil absorbable pigment.

* * * * *